US005367464A

United States Patent [19]

Abumehdi et al.

[11] Patent Number: 5,367,464

[45] Date of Patent: Nov. 22, 1994

[54] FRANKING METER SYSTEM

[75] Inventors: Cyrus Abumehdi, Harlow; William J. Herring, Brentwood, both of United Kingdom

[73] Assignee: Neopost Limited, Essex, United Kingdom

[21] Appl. No.: 993,849

[22] Filed: Dec. 21, 1992

[30] Foreign Application Priority Data

Dec. 30, 1991 [GB] United Kingdom ..... 9127477.9

[51] Int. Cl.[5] ..... G07B 17/00

[52] U.S. Cl. ..... 364/464.02; 235/380; 902/22

[58] Field of Search ..... 235/380, 381, 382, 382.5; 364/464.02, 464.03; 902/22

[56] References Cited

U.S. PATENT DOCUMENTS

| | | | |
|---|---|---|---|
| 3,792,446 | 2/1974 | McFiggins et al. | 364/464.02 X |
| 4,376,299 | 3/1983 | Rivest | 380/23 |
| 4,447,890 | 5/1984 | Duwel | 364/464.02 |
| 4,757,532 | 7/1988 | Gilham | 380/23 |
| 4,785,417 | 11/1988 | Obrea | 364/550 X |
| 4,907,271 | 3/1990 | Gilham | 380/25 |
| 5,077,792 | 12/1991 | Herring | 364/464.02 X |
| 5,237,506 | 8/1993 | Horbal et al. | 235/382 X |

FOREIGN PATENT DOCUMENTS 0442761 8/1991 European Pat. Off. .

*Primary Examiner*—Edward R. Cosimano

*Attorney, Agent, or Firm*—Shoemaker and Mattare, Ltd.

[57] ABSTRACT

A system for remote resetting of franking meters is disclosed in which the meters communicate with a central resetting terminal. A transaction identification number (IDN) is generated at the resetting terminal and also at the meter. Initially the IDN's match. The IDN at the terminal is incremented when the terminal sends a recredit signal to the meter and accounts for the recredit amount. The IDN at the meter is incremented when the descending register of the meter is recredited. In response to a recredit request which includes the meter IDN the terminal compares the IDN from the meter with that stored at the terminal. If the IDN's match the terminal recredits the meter with the requested amount. If the comparison indicates that the IDN from the meter was not incremented in the preceding recredit routine, indicating that the meter was not recredited in the preceding routine, the terminal recredits the meter with the amount of the preceding request.

10 Claims, 5 Drawing Sheets 18
16
17
KEYBOARD
DISPLAY
ROM
$10_1$

19
MEMORY
MICRO-PROCESSOR
15
I/O
MODEM
$11_1$
20
MEMORY
22
23
27
MEMORY IDN & TID
PRINTER
RAM
21
24
12
FRANKING MACHINE
MODEM
$11_2$
$10_2$
TELEPHONE NETWORK
14
MODEM
13
I/O
26
FRANKING MACHINE
MODEM
$11_3$
$10_3$
28
MICRO-PROCESSOR
MEMORY
MEMORY
29
25
FRANKING MACHINE
MODEM
$11_n$
$10_n$

FRANKING METER SYSTEM

BACKGROUND OF THE INVENTION

This invention relates to franking meter systems in which franking machines are utilized to frank postal items with a value of postage charge and in which funding of the franking machines with credit for use in franking is effected remotely.

Meters of franking machines for franking postal items and which are operated on a prepayment system are provided with a credit register which stores a value of credit for which payment has been made to a postal authority and which remains available for use in franking of mail items. Initially, upon payment to the postal authority, a value is entered into the credit register corresponding to the payment. As items are franked with postage charges, the value in the credit register is decremented by the postal charges and hence the decremented value represents the value remaining available for franking of postal items. When the value in the credit register has reduced to a predetermined value, which may be zero or a preset higher value, the accounting and control circuits of the franking meter prevent further franking operations until the user of the franking machine has purchased further credit from the postal authority and the value in the credit register has been incremented by the value of purchased credit. For reasons of security, the user of the machine is not permitted to have access to the interior of the franking meter or to any of the accounting circuits of the meter. According the addition of credit to the credit register is not permitted to be effected by the user of the machine. In known franking machines, the franking meter is a detachable module and when additional credit is to be entered in the meter the module is taken to the postal authority for resetting of the credit register. When the meter is returned to the postal authority for resetting the credit register, the postal authority is enabled to effect an auditing operation in which the contents of the credit register and other registers such as a tote register which records the total value of franking issued by the meter and an item counter which records the number of items franked by the meter are read. The auditing operation enables the postal authority to check usage of the machine as recorded by the various registers to ensure that the data in the registers is in agreement with usage of the machine since the preceding auditing.

The need to take the meter to a postal authority centre is inconvenient and time consuming to users of franking machines. The machine is not operable while the meter is removed for resetting and hence users need to anticipate their need for credit in order to prevent interruption to franking of mail items. In addition, the postal authority has to provide a resetting service at a large number of locations, for example at every main post office, in order to provide adequate accessibility of the service to customers.

In order to overcome the inconvenience of removing the meter and taking it to a postal authority resetting centre remote resetting systems have been proposed and are used. In one system, which is the subject of United Kingdom Patent No. 2173738, an electronic storage module is utilised to carry data between a postal authority resetting centre and franking machines at users locations. The module has credit data entered into and stored in it by the postal authority and after receipt thereof by the customer, the module is connected to the meter to enable the meter to read the credit data. The meter enters audit data into the module and upon return of the module to the postal authority, the postal authority reads the audit data and is enabled to carry out auditing of the usage of the meter. Thus the meter does not need to be removed from the franking machine and resetting is effected at the user's location. All data for the resetting of credit and auditing is carried by the module which is of sufficiently small size to be sent as a mail item between the user's location and the postal authority resetting centre. In order to provide security for the data transported in the module, the module also carries a code in the form of a pseudo-random number. This code is stored in the resetting computer and is written into the module together with the credit up-date value. The franking meter stores a code corresponding to that stored in the resetting computer. When the module is connected to the franking meter, the code in the module is compared with the code stored in the meter. If there is a match, the data in the module is accepted as valid. The code is changed after completion of each resetting transaction to prevent fraudulent resetting of the meter.

In another known system, resetting of the credit register of a franking meter is effected remotely by connecting the franking meter, by means of a modem, to the telephone network to provide direct communication with the resetting center computer. The procedure necessary for remote resetting of the register requires a sequence of messages to be passed between the franking meter and the resetting centre computer to enable the resetting centre computer not only to reset the credit value in the credit register but also to receive the accounting values stored in the other registers of the meter. If franking transactions were permitted to be carried out during the period in which the resetting procedure is taking place, accounting values stored in the registers of the franking meter would be changed in accordance with the postage value used in any franking transactions and accordingly auditing checks carried out to determine that the up-date credit value has been properly entered into the credit register and that the accounting data in other registers is in agreement could be indeterminate. Accordingly in a previously proposed system, which is the subject of U.S. Pat. No. 5,077,792, after initiation of the resetting procedure the resetting computer sends a message to the franking meter which locks and inhibits the franking machine from carrying out franking transactions. Upon completion of the resetting procedure after an audit of the register values of the franking meter has been satisfactorily carried out by the resetting computer the resetting computer sends an unlock message which permits the franking machine to carry out franking transactions. While this system is satisfactory with regard to preventing use of the franking machine while a resetting procedure is in progress it is considered that it may be disadvantageous in that if there is a failure in the resetting procedure due for example to equipment failure or a to failure in the communication link between the franking meter and the resetting centre computer the franking machine will remain locked and unavailable for use in franking mail items even though there is sufficient credit available in the credit register for franking further mail items.

SUMMARIES OF THE INVENTION

According to a first aspect of the invention a method of remotely resetting credit available for use in the franking transactions of franking meter apparatus, said franking meter apparatus including a descending credit register storing a value of credit available for use in franking transactions, includes the steps of generating a first indicator signal at the meter; generating a second indicator signal at a remote resetting terminal apparatus; establishing communication between the franking meter apparatus and the remote resetting terminal apparatus; transmitting the first indicator signal from the meter to the terminal; at the terminal apparatus comparing the first and second indicator signals; in response to detection of a first relationship between said first and second indicator signals transmitting a first credit reset signal from said terminal apparatus to said meter apparatus to enable the meter apparatus to reset the value of credit available for franking stored in the credit register of said meter apparatus by adding a first credit update amount to said value of credit and in response to detection of a second relationship between said first and second indicator signals transmitting a second credit rest signal from the terminal apparatus to the meter apparatus to enable the meter apparatus to reset the value of credit available for franking stored in the credit register of the meter apparatus by adding a second update credit amount to said value of credit.

According to a second aspect of the invention a method of remotely resetting credit in a series of credit resetting transactions of credit available for use in franking transactions of franking meter apparatus, said franking meter apparatus including a descending credit register storing a value of credit available for use in the franking transactions, includes the steps of generating a first indicator signal at the meter; generating a second indicator signal at a remote resetting terminal apparatus, said first and second indicator signals initially having a predetermined relationship; in each credit resetting transaction of the series establishing communication between the franking meter apparatus and the remote resetting terminal apparatus; carrying out a credit resetting routing in which a credit reset signal is transmitted from the terminal apparatus to the meter apparatus and the value in the credit register of the meter apparatus is reset in response receipt by the meter apparatus of the credit reset signal; incrementing the first indicator signal in response to resetting of the value in the credit register of the meter and incrementing the second indicator signal in response to completion of a resetting routine at the terminal; in each credit resetting transaction after an initial resetting transaction of the series of transactions checking the reset status of the credit register of the meter apparatus by transmitting the first indicator signal from the meter to the terminal; at the terminal apparatus comparing the first and second indicator signals; detection of said predetermined relationship between said first and second indicator signals providing a reset status indication that the value in the credit register was successfully reset in said preceding transaction and detection of absence of said predetermined relationship providing a reset status indication that the value in the credit register was not reset in the preceding transaction.

According to a third aspect of the invention remote resetting terminal apparatus for resetting a value of credit available for franking transactions in a credit register of franking meter apparatus in a series of resetting transactions includes means to generate a first indicator signal; means to receive a second indicator signal from franking meter apparatus, said first and second indicator signals initially having a predetermined relationship; means operable in each current credit resetting transaction to compare said first and second indicator signals; means operative in response to detection of said predetermined relationship between said first and second indicator signals to transmit a current credit reset signal relating to the current credit resetting transaction an operative in the absence of detection of said predetermined relationship to transmit a preceding credit reset signal relating to a credit reset transaction immediately preceding the current transaction.

According to a fourth aspect of the invention a franking meter system comprises at least one franking meter apparatus and remote resetting terminal apparatus; communication means providing communication between the meter apparatus and the remote resetting terminal apparatus; said franking meter apparatus including a credit register to store a value of credit available for use by said meter apparatus in franking transactions to frank mail items with a postage charge; means operable to reset the value of credit in the credit register to a new updated value; means to generate a first indicator number and to increment said indicator number in response to resetting of credit in the credit register; said remote resetting terminal apparatus including means operable to carry out a credit resetting routine; means to generate a second indicator number and to increment said second indicator number in response to completion of said credit resetting routine; said first and second indicator numbers initially having a predetermined relationship; comparison means to compare the first and second indicator numbers; means operative in response to said comparison means indicating said predetermined relationship between said first and second indicator numbers to transmit a first reset signal to said meter apparatus in respect to a first credit update value relating to a current resetting transaction between the meter apparatus and the terminal apparatus and operative in response to said comparison means indicating absence of said predetermined relationship to transmit a second reset signal to said meter apparatus in respect of a second credit update value relating to a preceding credit transaction in which a failure to reset the value of credit in the credit register occurred.

BRIEF DESCRIPTION OF THE DRAWING

An embodiment of the invention will now be described by way of example with reference to the drawings in which.

DESCRIPTION OF THE PREFERRED EMBODIMENT

Figure 1:
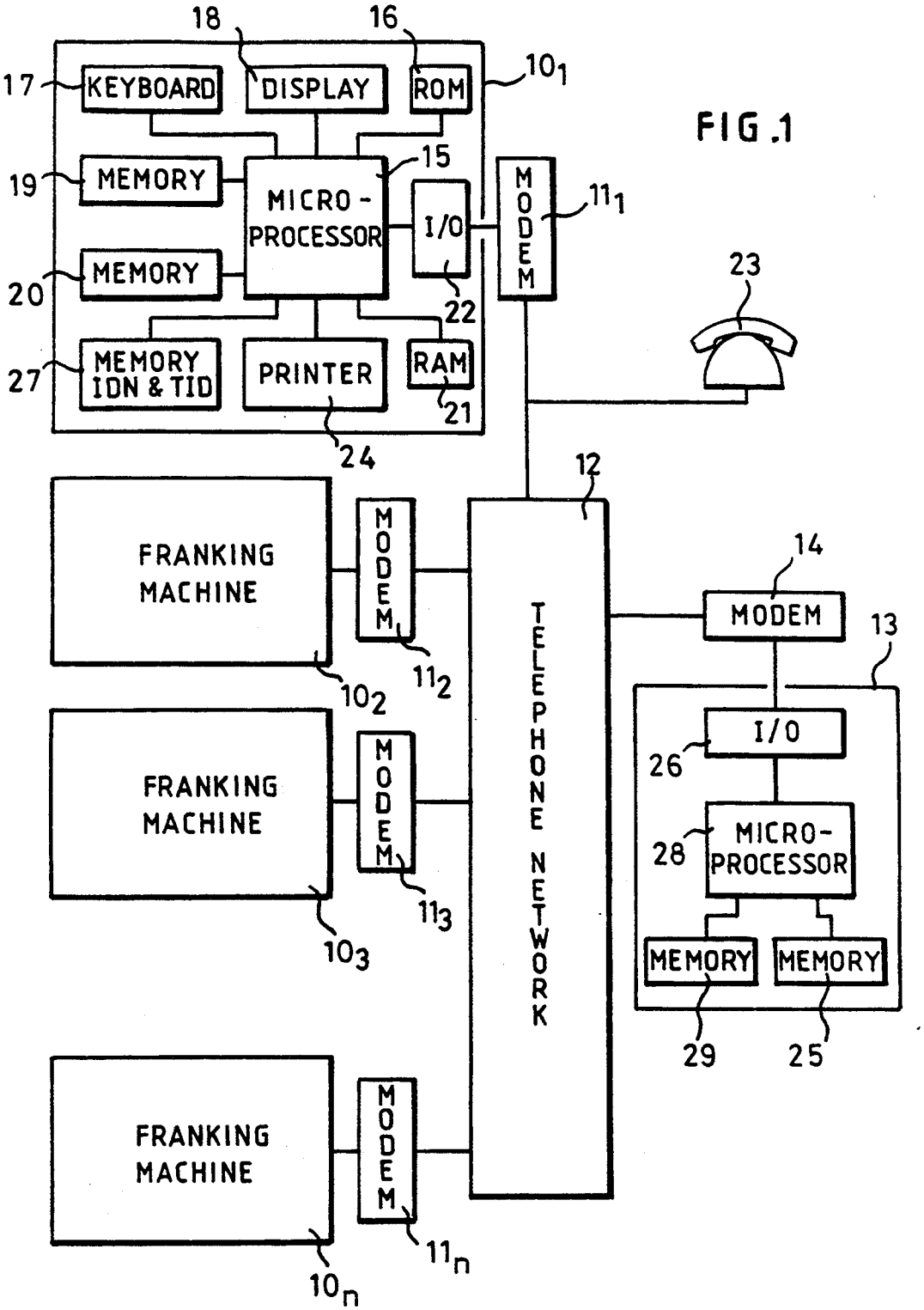
FIG. 1 is a block diagram showing franking meters connected by telephone network to a remote resetting terminal.

Referring to FIG. 1 of the drawings, franking meters $\mathbf{10}_1$, $\mathbf{10}_2$. . . $\mathbf{10}_n$ are connected via modems $\mathbf{11}_1$, $\mathbf{11}_2$. . . $\mathbf{11}_n$ to a telephone network 12. Similarly a remote terminal 13 at a postal authority resetting centre is connected to the telephone network by a modem 14.

The franking meters $10_1$, $10_2$ . . . $10_n$ are of the same construction and operate in the same manner. Accordingly only one franking meter $10_1$ will be described in detail. The franking meter $10_1$ comprises a secure housing within which electronic accounting and control circuits are located. The electronic circuits include a micro-processor 15 operating under the control of software routines stored in a read only program memory (ROM) 16 to carry out accounting and control functions of the meter. The meter is provided with a keyboard 17 which has numeric keys and control keys for entry, by a user of the meter, of data and control signals respectively to the micro-processor 15 and a display 18 for display of data and machine status signals to the user. Non-volatile memories 19 and 20 are provided for storing accounting data relating to usage of the meter in carrying out franking operations. A random access memory (RAM) 21 is provided as a working store for the micro-processor. The memories 19, 20 each provide a credit register for value of credit remaining available for use in franking, a tote register for accumulated value of franking carried out by the meter, an items register for the number of items franked by the meter and a high items register for the number of items franked by the meter with a value of postage charge above a predetermined value. Each register is duplicated within each of the memories. Thus each item of accounting data is stored in four registers thereby ensuring that, in the event of an error in operation of the memories or the accounting circuits, integrity of the accounting data stored in the meter can be checked and if an error is detected the correct accounting data can be restored. In each franking operation, the credit registers are each decremented by the value of the postage charge, the tote registers are incremented by the value of postage charge and the item count is incremented by one. In addition, if the mail item is franked with a postage value in excess of a predetermined value, the high items count is incremented by one. Prior to carrying out each franking operation, the micro-processor reads the credit value in the credit registers to ensure that the credit value is higher than a predetermined value and that the credit value is sufficient for the postage charge of the intended franking. If the credit value is less than the predetermined value, the meter locks and cannot be used for further franking until the credit register has been reset with additional credit. A non-volatile memory 27 is provided for storing data utilised in remote resetting of the franking meter. Such data includes permanent data such as meter identification data comprising a meter licence number and the telephone number of the remote resetting centre 13 with which the meter communicates to effect resetting of the credit register of the meter.

Resetting of the meter with additional credit is effected by means of inter-acting routines effected by the franking meter and the remote resetting terminal 13 via communication over the telephone network 12. Generally such resetting routines will be initiated by a user at the location of the franking meter. In order to enable the meter to communicate via the telephone network, an input/output interface circuit 22 is connected between input/output ports of the micro-processor 16 and the modem $11_1$. The modem $11_1$ may be an external unit, as illustrated in the drawing, connected to the meter by plug and socket connection or may be located internally of the meter housing with a plug and socket connection to the telephone network. The meter may be provided with an auto-dialling routine whereby the meter reads the telephone number allocated to the remote terminal stored in the non-volatile memory 27 of the meter and transmits dial pulses, or tones, corresponding to the telephone number. If such auto-dialling is not provided, a telephone handset 23 is connected in parallel with the modem to enable a user wishing to cause communication of the franking meter with the remote terminal to monitor the progress of the telephone call and to dial the appropriate telephone number. It will be appreciated that if the telephone network operates digitally, the modems are not required and the franking machine 10 and the remote terminal 13 are connected directly to the telephone network 12. The franking meter includes a printer 24 controlled by the microprocessor 15 to print franking impressions on mail items. The franking impressions contains a value of postage selected by a user by keying in the selected value on the keyboard 17.

The resetting terminal 13 comprises a computer which includes a processor 28 operating under the control of program routines stored in a memory 29 and a random access memory 25 for storing customer records. For communication with franking meters via the telephone network 12, the processor 28 is connected to the modem 14 by means of interface circuits 26. It is to be understood that the memories 29 and 25 are non-volatile and retain data stored therein in the event of a power failure.

Figures 2A, 2B:
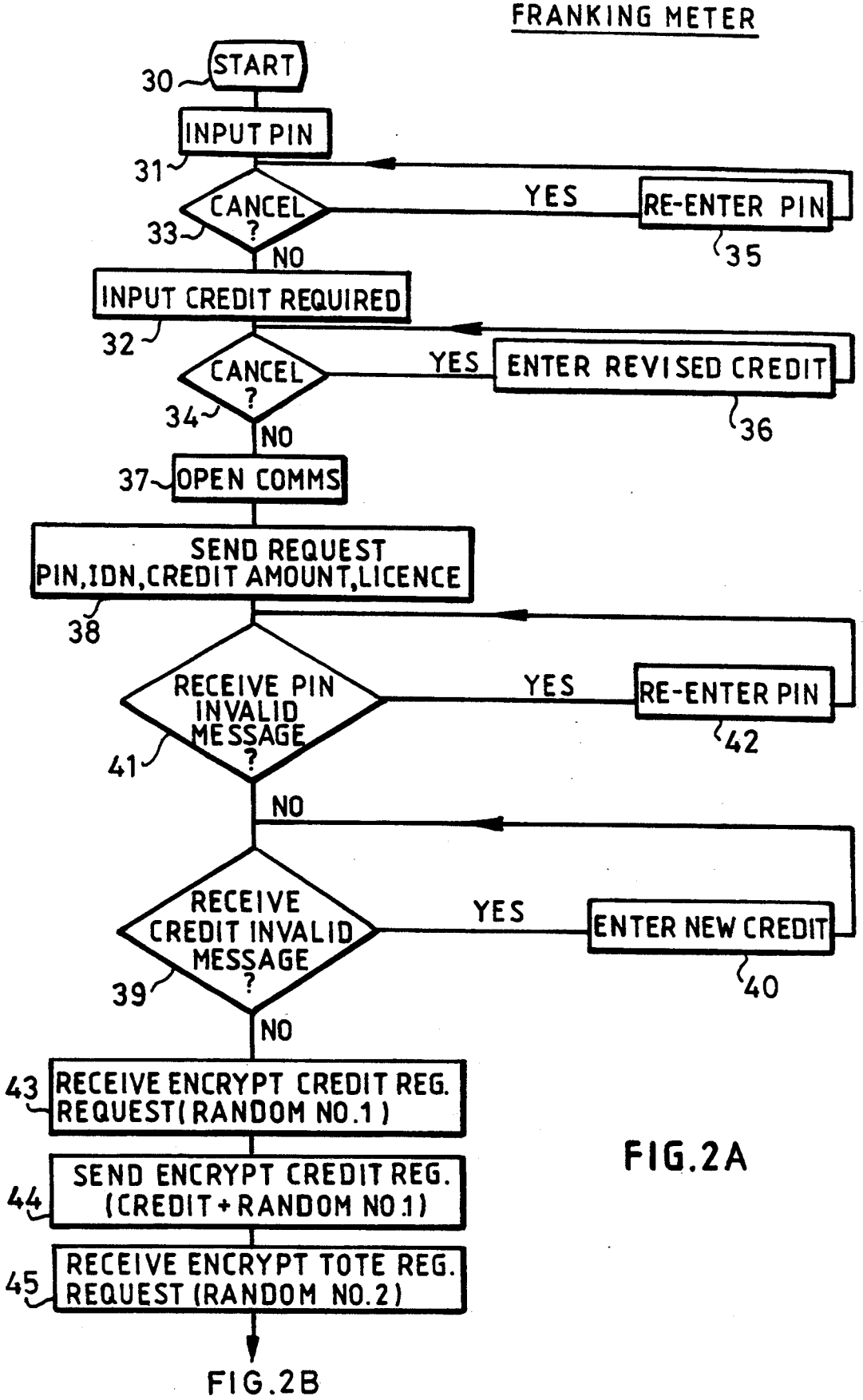
FIGS. 2A and 2B are a flow chart of a resetting routine carried out by the franking meter.
Figure 2B:
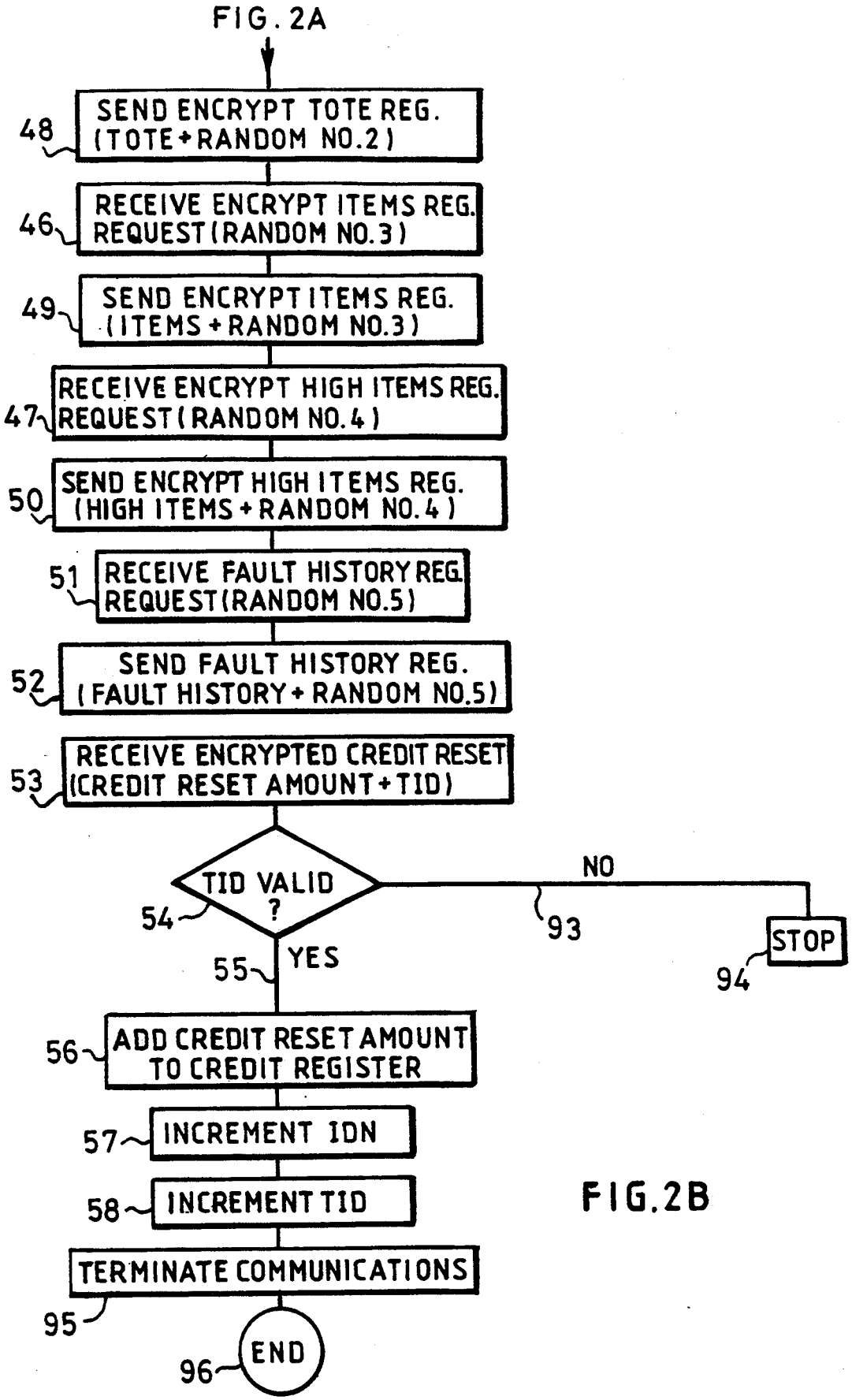

When a user requires additional credit for use in franking, the user operates a control key of the keyboard 17 to initiate a credit resetting mode of operation in which a resetting program routine is operated. The main steps of the resetting program routine are illustrated by the flow chart of FIG. 2. The microprocessor 15 operates under the resetting program routine and causes the display 18 to indicate to the user that the meter is in resetting mode. In order to prevent unauthorised personnel using the resetting mode to reset the credit in the meter, after START at 30 of the routine, the user is required to enter a personal identification number (PIN) at 31 by means of the keyboard. Following this, the amount of credit required is entered at 32 by means of the keyboard. As the user keys in the PIN and amount of credit required, the PIN and credit amount are displayed respectively on the display 18 to enable the user to verify that the PIN and credit amount keyed in are correct. If the user realises that an error has been made in entering the PIN, or if the user wishes to revise the amount of credit required, the respective entry may be cancelled at 33 or 34 and the user may re-enter the PIN at 35 and credit amount at 36 required as appropriate. The microprocessor of the meter opens communication at 37 via the modem 11 with the telephone network 12, and if an auto-dialling facility is provided, the microprocessor reads out the telephone number of the resetting terminal from the non-volatile memory 27 and sends corresponding dialling pulses, or tones if the telephone network operates on tone dialling, to the telephone network to establish telephonic communication with the remote resetting terminal. If an auto-dialling facility is not provided the user dials the remote terminal number on the telephone handset 23 and when an answer signal, which may be tone or computer generated voice, is received from the remote terminal the user replaces the handset. When the dialling is effected manually by means of the handset, the meter program routine allows a predetermined time period for replacement of the handset prior to continuing with the credit resetting routine. The meter then sends a 'request payment' message at 38 comprising the personal identification number, the payment amount required, a transaction indicator number (IDN) and the meter licence number to the resetting terminal. The transaction indicator number comprises a number stored in the non-volatile memory 27 of the meter and which is incremented each time the credit register of the meter is reset with an up-dated credit value in a remote resetting routine by the resetting terminal. Thus the IDN stored in the meter provides an indication of the resetting transaction sequence status as regards re-setting of the credit register of the meter. If desired the transaction indicator number may be incremented linearly or in any other predetermined and predictable manner. The resetting terminal also stores an IDN corresponding to the IDN stored in the meter as will explained hereinafter.

Figure 3A:
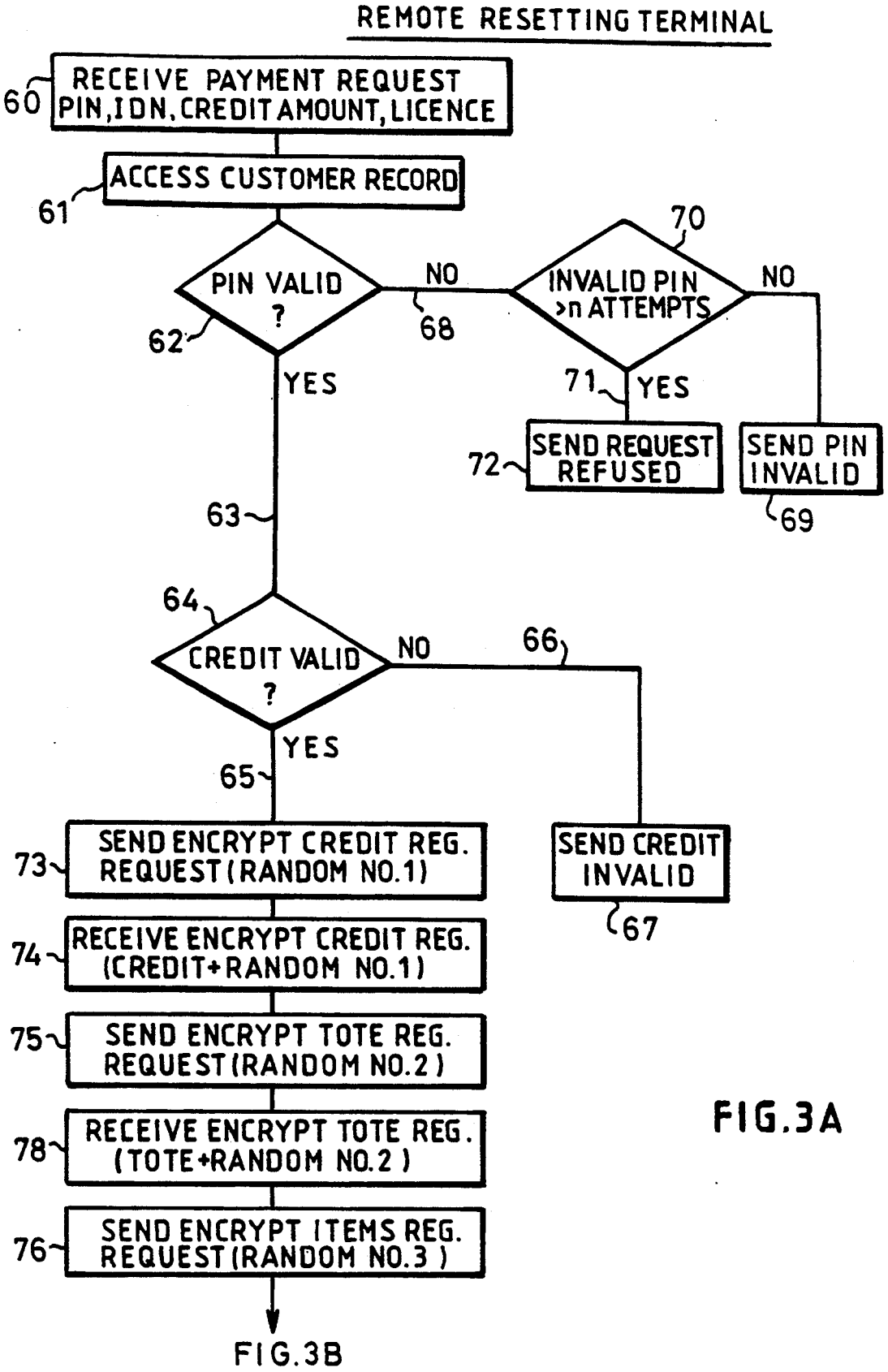
FIGS. 3A and 3B are a flow chart of a resetting routine carried out by the resetting terminal.
Figure 3B:
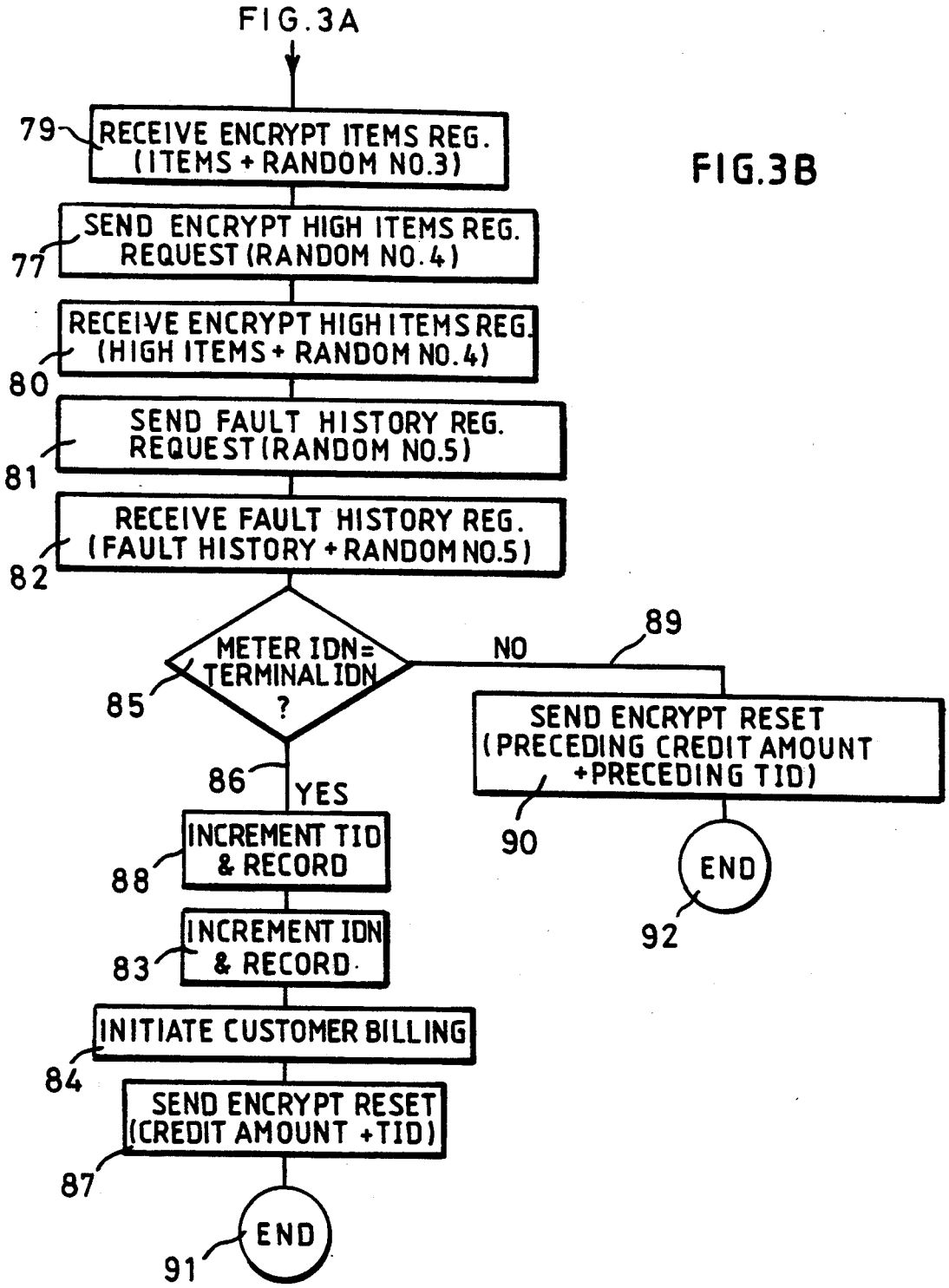

The resetting terminal is arranged to carry out a credit resetting program routine, the main steps of which are illustrated by the flow chart of FIG. 3, when communication between the meter and the terminal is opened. Upon receipt of the 'request payment' message at 60 from one of the meters $10_1 \ldots 10_n$, the processor 28 of the resetting terminal accesses a record of customer data at 61 in memory 25 relating to the specific meter, as identified by the received licence number, which has opened communication with the terminal. The record of customer data includes the personal identification number or numbers authorised for each meter as identified by the meter licence number. The terminal compares at 62 the received personal identification number with the personal identification number(s) in the stored record for the received licence number. The customer record also contains data relating to the credit status of the customer. If the received personal identification number matches that for the meter licence number in the stored record, flow line 'YES' 63, and the amount of credit requested in the payment request is acceptable as regards the credit status of the customer and as regards any limits which may be imposed on the amount of credit which may be requested, as determined by 'CREDIT VALID'? at 64, the resetting terminal proceeds, flow line 65, with the credit resetting program routine. However if the request for credit is unacceptable, flow line 66, for example it is for too large an amount of credit, the terminal returns a 'CREDIT INVALID' message at 67. Of if the personal identification number is incorrect, flow line 'NO' 68, the terminal returns a 'PIN invalid' message at 69 to the meter. The messages sent at 67 and 69 contain an indication relating to the error which has occurred and this causes an appropriate indication to be displayed to the user. If the amount of credit requested is too large the resetting routine is terminated. However if desired, if the meter receives the 'CREDIT INVALID' message at 39, the user may be permitted to enter at 40 a new smaller amount of credit. If the personal identification number is incorrect 'PIN INVALID' message received at 41, the user may enter an alternative personal identification number at 42. When an incorrect personal identification number is entered and the user enters further numbers as identification numbers the resetting terminal logs at 70 the number of sequential incorrect personal identification numbers received. If a predetermined limit 'n' of entered personal identification numbers is reached, flow line 'YES' 71, the resetting terminal rejects any further requests for credit and sends a 'request refused' message at 72 for display by the meter. If the meter bearing the licence number in the request credit message has not yet been installed in an authorised procedure or the licence number is not recognised by the resetting terminal, the terminal sends a 'request refused' message to the meter.

The resetting terminal sends a series of messages to the meter to read and send to the terminal in encrypted format the accounting data held in the registers of the non-volatile memories 19, 20 of the meter. The resetting terminal sends an 'encrypt credit register request' message at 73 to the meter to read the contents of the credit register. This message contains a random number generated by the resetting terminal. Upon receipt at 43 of the 'encrypt credit register request' message the meter responds to this message by reading the contents of the credit register and transmitting a 'encrypt credit register' message at 44 to be received at 74 by the resetting terminal. This message contains this credit value and the random number encrypted. The terminal sends a series of similar request messages at 75, 76 and 77 to the meter to read the contents of the tote register, the items count register and the high items register in the meter. Each of these 'encrypt register request' messages includes a random number as explained hereinbefore. In response to receipt at 45, 46 and 47 of these 'encrypt register request' messages respectively, the meter returns 'encrypted tote register' at 48, encrypted items register at 49 and encrypted high items register at 50 messages including the value of the content of the corresponding register together with the random number received in the 'encrypt register request' message. These messages are received by the terminal respectively at 78, 79 and 80. The terminal also sends a 'fault history register request' message at 81 received by the meter at 51. The meter responds by sending a 'fault history register' message at 52 which is received by the terminal at 82. The random number included in the 'encrypt register' message presenting the register value to the terminal is the random number transmitted to the meter by the terminal in the 'encrypt register request' message requesting the register value. The terminal checks that the random number received in the 'encrypt register' message from the meter is the same as that sent to the meter in the 'present encrypt register' message. In a resetting transaction, the same random number may be used in each message requesting values of different registers or if desired the random number may be different for each request message.

The resetting terminal stores in the customer record in memory 25 a transaction indicator number (IDN) relating to each of the meters. The IDN relating to a meter and stored in the resetting terminal is incremented at 83 each time the terminal completes a resetting routine in respect of the meter. It is preferred that this is at the stage when the terminal initiates a billing operation at 84 by which the customer or user of the meter is charged for credit issued by the terminal for the meter. Thus the IDN stored at the remote resetting terminal provides an indication of the resetting transaction sequence status as regards billing of the user for the value of credit issued by the terminal. Initially the IDN in the terminal is equal to the IDN in the meter. The IDN in the meter is incremented at 57 each time the credit register of the meter is reset remotely and accordingly for each credit reset transaction in which resetting of the credit register of the meter is accomplished successfully the IDNs in the terminal and in the meter are incremented and remain in step and are equal to one another. The resetting terminal compares at 85 the IDN received from the meter in the 'payment request' message with the IDN relating to that meter stored in the customer records at the terminal. If the IDNs are equal, flow line 'YES' 86, it indicates that the credit register of the meter was successfully updated with the new credit value in the preceding credit reset transaction.

The resetting terminal then sends an 'encrypted credit reset' message at 87 which contains the credit amount requested by the user together with a transaction identity code (TID) in the form of an encrypted data block. This 'encrypted credit reset' message is received by the meter at 53. The transaction identity code comprises a pseudo-random number generated by a pseudo-random number generator in the resetting terminal. The meter also includes a pseudo-random number generator which corresponds to that in the resetting terminal. Initially both the meter and the resetting terminal store corresponding pseudo-random numbers. Thus prior to a payment request the meter is storing in non-volatile memory 27, a pseudo-random number generated by the generator in the meter. Upon acceptance of a payment request, the resetting terminal generates the pseudo-random number at 38, corresponding to that stored in the meter, and includes this pseudo-random number in the 'encrypted credit reset' message. Upon receipt of the 'encrypted credit reset' message at 53 by the meter, the microprocessor 15 compares at 54 the TID contained in the 'encrypted credit reset' message with the TID stored in memory. If the comparison at 54 indicates identity between the TIDs, flow line 'YES' 55, the meter is enabled to add the credit up-date amount at 56 to the credit register in the memories 19, 20 and the pseudo-random number TID is incremented at 58 to the next number in the series of pseudo-random numbers. If identity is not found, flow line 'NO' 93, the payment transaction is not permitted to continue and failure of the transaction at 94 is indicated on the display to the user. At this stage the value in the credit register has not been modified by the addition of the requested payment and the meter can continued to be used for franking transactions but only with the current credit value remaining in the credit register.

If the resetting terminal has effected a reset program routine in which billing of the customer has been initiated but due to an unpredicted failure the credit register of the meter has not been reset the IDN in the terminal is incremented at 83 but the credit reset program routine of the meter does not proceed to the step at 57 of incrementing the IDN in the meter. As a result the IDNs will be out of step. Failure to reset the credit register in the meter may result from an unpredictable failure in communication between the terminal and the meter or due to a system failure in the meter. Accordingly when the terminal compares at 85 the IDN received from the meter with the IDN stored in the terminal the IDN will differ by an increment and this incremental difference between the IDNs provides an indication to the terminal that in the preceding resetting transaction for that meter there was a failure to reset the credit register of the meter. When the comparison at 85 indicates, flow line 'NO' 89, that the IDNs differ by the increment, the terminal sends an 'encrypt reset' message at 90 which, instead of the current requested credit amount, contains the preceding requested amount of credit. Thus the terminal, in response to detection of the incremental difference in the IDNs, carries out steps in the resetting routine to reset the credit register of the meter with the preceding requested amount of credit for which billing of the customer has already been effected at 84 in the preceding reset transaction. It will be understood that because the credit reset program routine in the meter was interrupted, the TID stored in the meter was not incremented at 58. Accordingly when the terminal detects that there is an incremental difference between the IDNs, the TID included in the 'encrypt reset' message is the TID currently stored in the terminal.

It is to be understood that if the resetting terminal carries out and completes a resetting routine at 91 and, for example, initiates billing of the user but, due to an unpredicted interruption in the transaction routine with the meter, the meter fails to reset the credit register with the required new updated credit value the IDN at the resetting terminal is incremented but the IDN stored in the meter is not incremented and remains at its previous value. As part of the resetting routine the resetting terminal receives the IDN currently stored in the meter and compares this received IDN with the IDN stored at the resetting terminal. If the IDNs correspond the resetting terminal continues with resetting the credit register of the meter with the amount of credit in the current request for credit. However if value of the IDN received from the meter is one less than the value of IDN stored at the terminal, indicating that the credit register of the meter failed to be updated in the previous transaction, the terminal proceeds to reset the credit register with the required value of credit contained in the previous request. After sending the value of credit contained in the previous request at 90 and completing the resetting routine in respect of that request, communication is terminated at 95 and the terminal and meter terminate the resetting routine at 92 and 96, respectively. However if desired resetting routine may include sending the value of credit in the current request and then completing the resetting routine. The meter maybe arranged to detect that an attempt to reset credit in the meter is not completed and, if the meter is provided with an auto-dialling facility, the meter may be arranged to retry a credit resetting routine for the same amount of credit automatically. It will be appreciated that in such a situation the value of IDN received by the terminal will indicate to the terminal that the preceding attempt to reset credit in the meter was not completed.

While the memory 27 is shown in FIG. 1 as being separate from the memories 19, 20, it is to be understood that the registers implemented by the memory 27 may be implemented instead by storage locations within one or both memories 19, 20.

It will be appreciated that any of the message referred to hereinbefore which contain data which it is desired to keep secure would be transmitted in encrypted form and decrypted by the receiving meter or terminal respectively. Those messages which contain only data which it is not necessary to keep secure may be transmitted without encryption. However it may be convenient in order to handle all messages in the same manner to encrypt all messages at the transmitter and to decrypt all messages at the receiver.

The resetting terminal preferably maintains a record of account for the user which contains a value of credit available for allocation to a user of the franking meter. After the terminal has sent the 'encrypt reset' message the credit available for allocation to the user is decremented by the credit up-date amount. The value of credit available for allocation may be purchased in advance or, if permitted by the postal authority, an agreed limit of credit may be made available for which payment is made in arrears. The record of account is utilised for preparing the billing by which the customer is charged for credit transmitted by the terminal for a meter.

While the communication between the franking meter and the resetting terminal has been described hereinbefore as utilising a telephone network, if desired the communication may be by way of a dedicated transmission line or by other forms of communication such as radio communication.

Each message may include a task identification to enable the meter and the terminal to identify messages receives from the terminal and meter respectively.

After sending the 'request payment' message, the meter may indicate an error condition if a correct response message is not received back from the terminal within a predetermined time period, for example 30 seconds. While the meter is waiting for a response from the terminal all keyboard inputs are ignored by the micro-processor.

In the event of communication failure or power failure at the meter, the meter remains available for franking transactions when power is available. Upon re-establishment of communication or power, the resetting routine, if not completed, can be re-initiated. As described hereinbefore comparison by the terminal of the IDNs stored in the meter and in the terminal enables the terminal to determine whether the resetting routine effected resetting of the credit register of the meter with the requested credit amount or that the credit register was not reset and the requested amount needs to by resent by the terminal. Conveniently the IDN in the meter and the terminal are equal and remain equal after each successful completion of a resetting routine. However if desired the IDNs may be different and be maintained to have a predetermined relationship other than equality. The IDNs provide an indication of synchronisation status of the meter and terminal and is not secure information. The IDNs may be a relatively small integer incremented by unity on a recirculating basis.

In order to overcome problems which could arise due to unexpected lockout of the meter due to low credit and to difficulty in establishing communication between the franking meter and the terminal, the meter may be arranged to provide advance warning that lock out of the meter is likely to occur shortly due to the credit value decreasing to below a predetermined limit. This has the effect of providing a tolerance to low credit limit thereby enabling the user to continue using the franking meter for a limited amount of franking after provision of the warning.

We claim:

1. A method of remotely resetting credit available for use in the franking transactions of franking meter apparatus, said franking meter apparatus including a descending credit register storing a value of credit available for use in franking transactions; including the steps of:

generating a first indicator signal at the meter;

generating a second indicator signal at a remote resetting terminal apparatus;

establishing communication between the franking meter apparatus and the remote resetting terminal apparatus;

transmitting the first indicator signal from the meter to the terminal;

at the terminal apparatus comparing the first and second indicator signals;

in response to detection of a first relationship between said first and second indicator signals transmitting a first credit reset signal from said terminal apparatus to said meter apparatus to enable the meter apparatus to reset the value of credit available for franking stored in the credit register of said meter apparatus by adding a first credit update amount to said value of credit and in response to detection of a second relationship between said first and second indicator signals transmitting a second credit reset signal from the terminal apparatus to the meter apparatus to enable the meter apparatus to reset the value of credit available for franking stored in the credit register of the meter apparatus by adding a second update credit amount to said value of credit.

2. A method of remotely resetting credit as claimed in claim 1 including the steps of storing a first pseudo-random number in the meter apparatus;

generating a second pseudo-random number in the resetting terminal apparatus, said second pseudo-random number corresponding to said first pseudo-random number; including said second pseudo-random number in the reset signal transmitted from the terminal apparatus to the meter apparatus;

in the meter comparing the first and second pseudo-random numbers and in response to the comparison indicating that the first and second pseudo-random numbers correspond resetting the value in the credit register by an amount determined by the reset signal.

3. A claim of remotely resetting credit in a series of credit resetting transactions of credit available for use in franking transactions of franking meter apparatus, said franking meter apparatus including a descending credit register storing a value of credit available for use in the franking transactions; including the steps of:

generating a first indicator signal at said franking meter apparatus; generating a second indicator signal at a remote resetting terminal apparatus, said first and second indicator signals initially having a predetermined relationship;

and in each current credit resetting transaction of said series of credit resetting transactions the steps of establishing communication between said franking meter apparatus and said remote resetting terminal apparatus;

carrying out a first credit resetting routine at said remote resetting terminal apparatus including transmitting a credit reset signal from said remote resetting terminal apparatus to said franking meter apparatus to enable said franking meter apparatus to reset the value of credit stored in said descending credit register of said franking meter apparatus;

carrying out a second credit resetting routine at said franking meter apparatus including resetting the value of credit stored in said descending credit register in response to receipt by said franking meter apparatus of said credit reset signal;

incrementing said first indicator signal in response to resetting the value of credit in said descending credit register of said franking meter apparatus;

incrementing said second indicator signal in response to completion of said first resetting routine at said remote resetting terminal apparatus;

transmitting said first indicator signal from said franking meter apparatus to said remote resetting terminal apparatus;

at said remote resetting terminal apparatus comparing said first and second indicator signal and in response to detecting said predetermined relationship between said first and second indicator signals generating a first reset status signal indicating that the value of credit in said descending credit register was successfully reset in a credit resetting transaction preceding the current credit resetting transaction and in response to detecting a relationship different from said predetermined relationship generating a second reset status signal indicating that the value of in said descending credit register was not reset in said credit resetting transaction preceding said current credit resetting transaction.

4. A method as claimed in claim 3 including the steps of:

resetting the value of credit in the descending credit register of the franking meter apparatus by a first update amount determined by a current credit reset signal transmitted by the remote resetting terminal apparatus in the current transaction of the series of credit resetting transactions in response to detecting the predetermined relationship and resetting the value of credit in the descending register of the franking meter apparatus by a second update amount determined by a preceding credit reset signal transmitted by the terminal apparatus in the credit resetting transaction preceding the current credit resetting transaction in response to failing to detect said predetermined relationship.

5. A method of remotely resetting credit as claimed in claim 4 including the steps of storing a first pseudo-random number in the franking meter apparatus;

generating a second pseudo-random number in the remote resetting terminal apparatus, said second pseudo-random number corresponding to said first pseudo-random number;

including said second pseudo-random number in the credit reset signal transmitted from said remote resetting terminal apparatus to the franking meter apparatus;

at said franking meter apparatus comparing the first and second pseudo-random numbers and in response to the comparison indicating that the first and second pseudo-random numbers correspond resetting the value of credit in the descending register by an amount determined by the credit reset signal.

6. A method as claimed in claim 4 wherein the predetermined relationship is equality.

7. Remote resetting terminal apparatus for resetting a value of credit available for franking transactions in a credit register of franking meter apparatus in a series of resetting transactions including:

means to generate a first indicator signal; means to receive a second indicator signal from franking meter apparatus, said first and second indicator signals initially having a predetermined relationship;

means operable in each current credit resetting transaction to compare said first and second indicator signals;

means operative in response to detection of said predetermined relationship between said first and second indicator signals to transmit a current credit reset signal relating to the current credit resetting transaction and operative in the absence of detection of said predetermined relationship to transmit a preceding credit reset signal relating to a credit reset transaction immediately preceding the current transaction.

8. Remote resetting terminal apparatus as claimed in claim 7 wherein the predetermined relationship is equality.

9. A franking meter system comprising at least one franking meter apparatus and remote resetting terminal apparatus;

communication means providing communication between the meter apparatus and the remote resetting terminal apparatus;

said franking meter apparatus including a credit register to store a value of credit available for use by said franking meter apparatus in franking transactions to frank mail items with a postage charge;

reset means operable to reset the value of credit in the credit register to an updated value of credit;

means to generate a first indicator number and to increment said indicator number in response to resetting of credit in the credit register;

said remote resetting terminal apparatus including means operable to carry out a credit resetting routine;

indicator means to generate a second indicator number said first and second indicator numbers initially having a predetermined relationship and said indicator means being operative to increment said second indicator number in response to completion of said credit resetting routine;

comparison means to compare the first and second indicator numbers;

means operative in response to said comparison means indicating said predetermined relationship between said first and second indicator numbers to transmit a first reset signal to said franking meter apparatus in respect of a first updated value of credit relating to a current resetting transaction between said franking meter apparatus and said remote resetting terminal apparatus and operative in response to said comparison means indicating a relationship different from said predetermined relationship to transmit a second reset signal to said franking meter apparatus in respect of a second updated value of credit relating to a credit resetting transaction preceding said current credit resetting transaction in which a failure to reset the value of credit in the credit register to the second updated value of credit occurred;

said credit reset means of said franking meter apparatus being operated in response to receipt of the reset signal from the remote resetting terminal apparatus.

10. A franking meter system as claimed in claim 9 wherein the predetermined relationship is equality.

* * * * *